US006363646B1

(12) United States Patent
Amadini

(10) Patent No.: US 6,363,646 B1
(45) Date of Patent: Apr. 2, 2002

(54) LOCKING MECHANISM FOR PISTOL

(76) Inventor: Sandro Amadini, Via 10 Giornate 82, Gardonne Val Trompia (IT), 25063

( * ) Notice: Subject to any disclaimer, the term of this patent is extended or adjusted under 35 U.S.C. 154(b) by 0 days.

(21) Appl. No.: 09/705,604

(22) Filed: Nov. 3, 2000

Related U.S. Application Data

(63) Continuation-in-part of application No. 09/527,356, filed on Mar. 17, 2000.

(51) Int. Cl.[7] ..... F41A 17/02
(52) U.S. Cl. ..... 42/70.11; 42/70.08
(58) Field of Search ..... 42/70.01, 70.08, 42/70.11

(56) References Cited

U.S. PATENT DOCUMENTS 4,672,762 A * 6/1987 Nilsson ..... 42/70.01
5,491,918 A * 2/1996 Elmstedt ..... 42/70.11
5,913,666 A * 6/1999 Perkins ..... 42/70.08

FOREIGN PATENT DOCUMENTS

GB 187093 * 10/1922 ..... 42/70.08

OTHER PUBLICATIONS

Sandro Amadini; Locking Mechanism For Pistol; Filed on Mar. 17, 2000, U.S. application No. 09/527,356.

* cited by examiner

*Primary Examiner*—Stephen M. Johnson
(74) *Attorney, Agent, or Firm*—J. Sanchelima; A. Bordas

(57) ABSTRACT

A locking mechanism that can be used on pistols having an enclosed firing pin assembly. The locking device primarily comprises a firing pin assembly, spacer sleeves, and a slide cover keyed plate. The locking mechanism is controlled by a key, giving the authorized user the ability to set the pistol in a "fire" or "locked" mode while the trigger is pressed and held. The locking mechanism is utilized as a means to prevent the movement of a pistol's firing pin assembly when activated by the trigger mechanism.

5 Claims, 2 Drawing Sheets

LOCKING MECHANISM FOR PISTOL

OTHER RELATED APPLICATIONS

The present application is a continuation-in-part of pending U.S. patent application Ser. No. 09/527,356, filed on Mar. 17, 2000, which is hereby incorporated by reference.

BACKGROUND OF THE INVENTION

1. Field of the Invention

The present invention relates to a locking mechanism for weapons, and more particularly, to a locking mechanism for pistols.

2. Description of the Related Art

Applicant believes that the closest reference corresponds to applicant's own patent application. The present application, however, includes subject matter not disclosed in the parent application, particularly, since the pistol may be locked and unlocked after the trigger is fully pressed and held.

Other patents describing the closest subject matter provide for a number of more or less complicated features that fail to solve the problem in an efficient and economical way. None of these patents suggest the novel features of the present invention.

DESCRIPTION OF THE RELATED ART

Many firearms today include safety lock mechanisms. However, these locking systems are cumbersome and usually require additional equipment not implemented within the pistol itself. The desirability of a locking mechanism cannot be understated since there are times when an authorized user needs peace of mind that the pistol is inoperable. Situations where children are around or even when there is a possibility that the pistol may be used against its owner, require that it be locked and rendered inoperable. There is a need for a practical and inexpensive assembly that can be incorporated into pistols without major structural changes to reduce the possibilities of unauthorized users from utilizing pistols.

There are no similar locking mechanisms to the best of applicant's knowledge, that are built-in the pistol and lock with the trigger pressed that utilize a key.

SUMMARY OF THE INVENTION

It is one of the main objects of the present invention to provide a locking mechanism for pistols that is utilized to lock the firing pin assembly without placing the pistol in battery.

It is still another object of the present invention to provide a key to set the pistol in a "fire" or "locked" mode after pulling and holding the trigger of the pistol.

It is still another object of the present invention to visually determine when the pistol is in the "fire" or "locked" mode.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
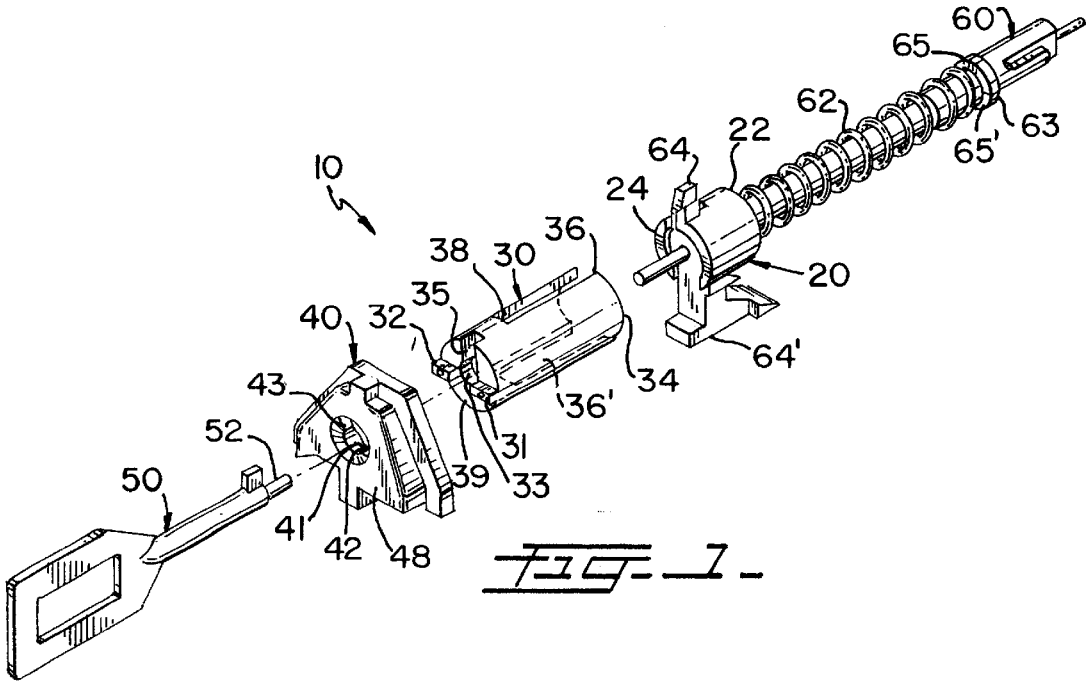
FIG. 1 represents an exploded view of the locking mechanism.

Referring now to the drawings, where the present invention is generally referred to with numeral 10, it can be observed that it basically includes spacer sleeve 20, cylindrical spacer sleeve assembly 30, keyed plate assembly 40, key 50 and firing pin assembly 60.

As seen in FIG. 1, spacer sleeve 20 slidably journals onto firing pin assembly 60 between one end of firing pin spring 62 and firing pin guide 64 and firing pin leg 64'. Spacer sleeve 20 has front edge 22 and rear edge 24, of which a portion abuts front edge 34 of spacer sleeve 30. Front edge 22 is in contact with firing spring 62. Spacer sleeve 20 is manufactured from a durable material such as stainless steel, or a material of similar characteristics.

Firing pin assembly 60 includes firing pin spring 62, which partially houses firing pin assembly 60 and is compressed between front edge 22 of spacer sleeve 20 and spring retaining cups 65 and 65', which are biased against stopper surface 63 of firing pin assembly 60. Due to the force applied by firing pin spring 62 against stopper surface 63, firing pin guide 64 and firing pin leg 64' are biased against spacer sleeve 20.

Figure 4:
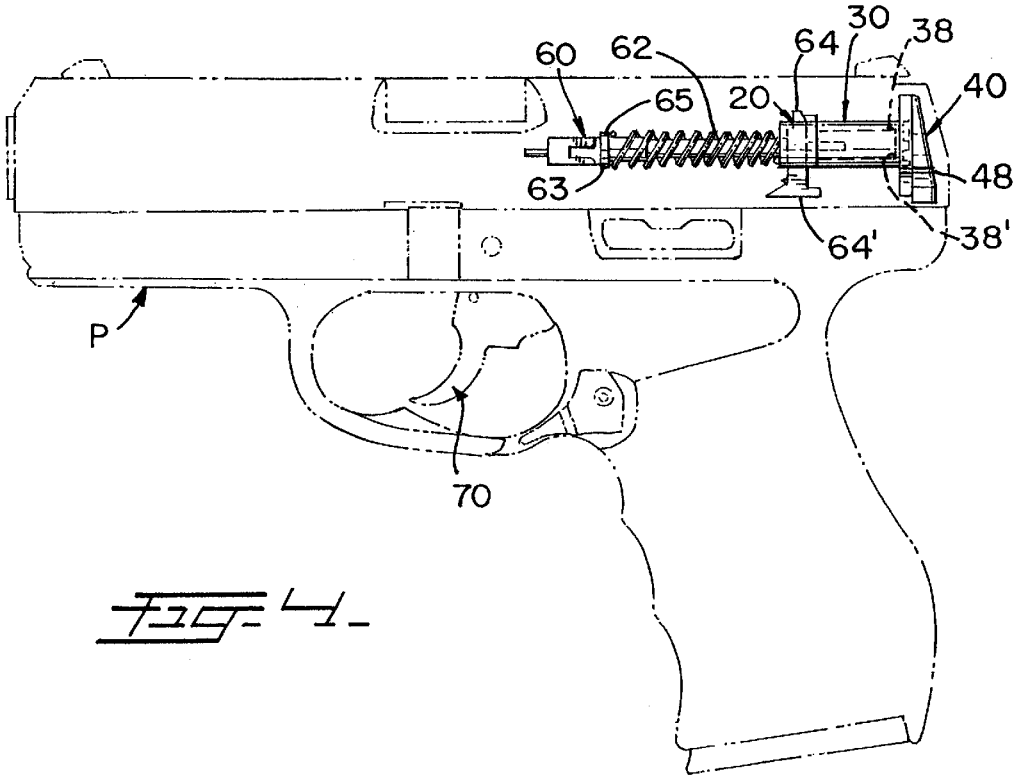
FIG. 4 illustrates an isometric view of a pistol showing the present invention in firing position.
Figure 3:
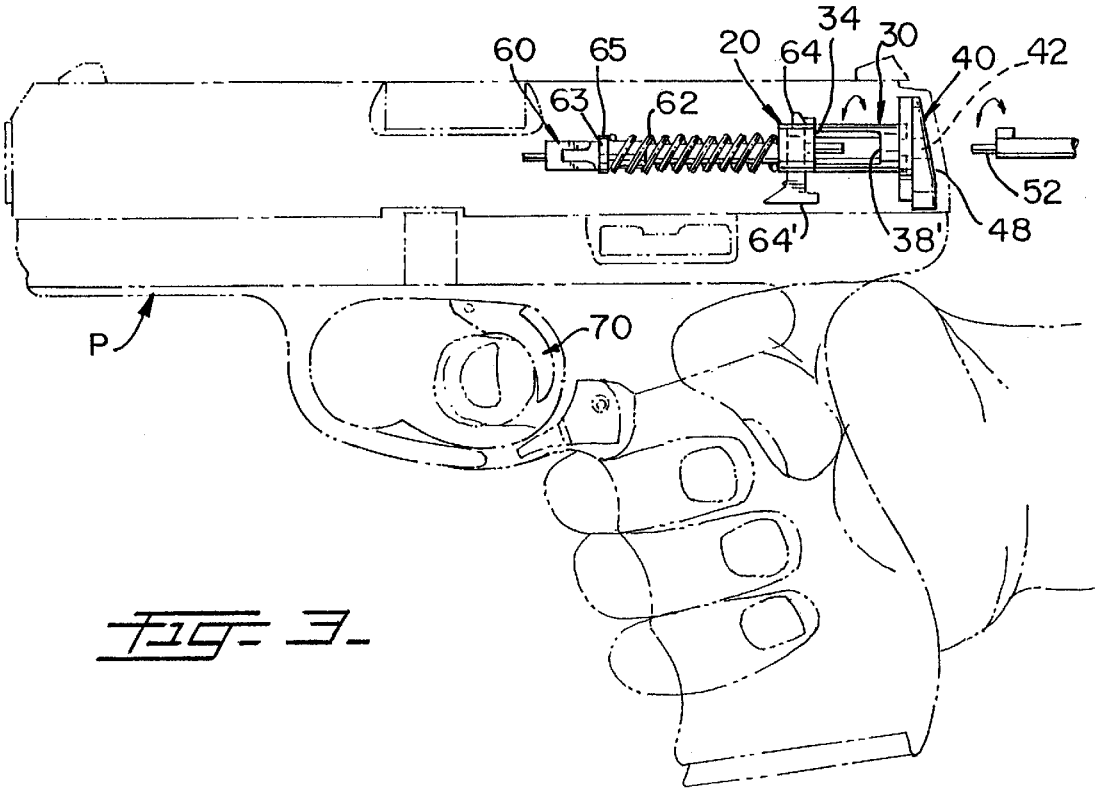
FIG. 3 illustrates an isometric view of a pistol showing the present invention in the locked position.

Cylindrical spacer sleeve assembly 30 has front edge 34 and rear exterior surface 39. Extending from front edge 34 towards rear exterior surface 39 are longitudinal cut-outs 36 and 36'. Longitudinal cut-outs 36 and 36' receive firing pin guide 64 and firing pin leg 64' respectively. Rear edges 38 and 38', seen in FIG. 3, are positioned at a parallel and spaced apart relationship with respect to front edge 34. While firing, firing pin guide 64 and firing pin leg 64' approach rear edges 38 and 38' respectively. Protruding from rear exterior surface 39 is fire cam 31 and lock cam 32, each serving as a means for indicating when pistol P, shown in FIGS. 3 and 4, is in fire or locked mode. Cylindrical spacer sleeve assembly 30 is manufactured from a durable material such as stainless steel, or a material of similar characteristics.

Keyed plate assembly 40 has exterior face 48 and key hole 42 therethrough to receive key 50. Notches 41 and 43 allow for visual sight of fire cam 31 and lock cam 32 respectively when properly aligned. Key 50 has a predetermined fixed end such as key end 52 or the equivalent, that cooperatively receives recess 33 of rear exterior surface 39.

Figure 2A:
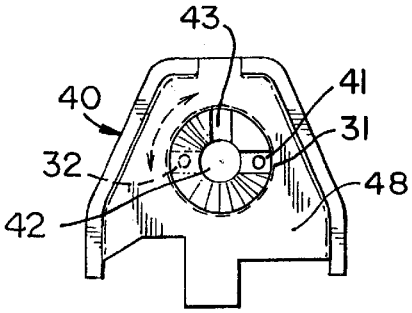
FIG. 2*a* shows an elevational view of the external face of the keyed plate assembly indicating the pistol is in firing mode.

As seen in FIG. 2*a,* fire cam 31 of cylindrical spacer sleeve 30 is aligned with notch 41 of keyed plate assembly 40. When aligned in this fashion, the authorized user is aware that pistol P, as shown in FIG. 3, is activated and in the fire mode.

Figure 2B:
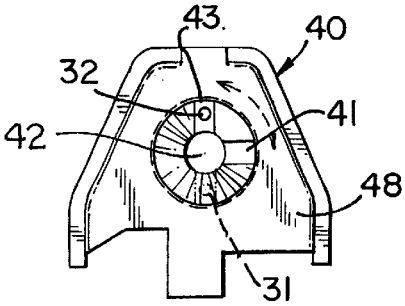
FIG. 2*b* shows an elevational view of the external face of the keyed plate assembly indicating the pistol is in locked mode.

As seen in FIG. 2*b,* lock cam 32 of cylindrical spacer sleeve 30 is aligned with notch 43 of keyed plate assembly 40. When aligned in this fashion, the authorized user is aware that pistol P, as shown in FIG. 3, is deactivated and is in the lock mode.

Figure 2C:
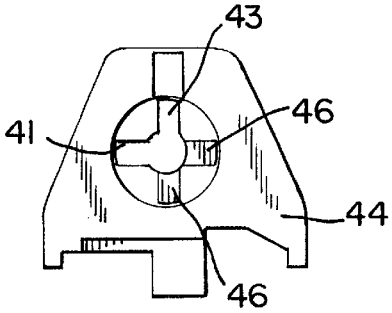
FIG. 2*c* shows an elevational view of the internal face of the keyed plate assembly.

As seen in FIG. 2*c,* interior face 44 contains at least two radially extending interior face notches 46 to receive spacer sleeve cam 35, seen in FIG. 1. Radially extending interior face notches 46 may vary in angular difference in respect to each other, with the preferred angle being 90 degrees.

As seen in FIG. 3, pistol P is in the locked mode. An authorized user inserts key end 52 into key hole 42 of keyed plate 40. Key end 52 is shaped to fit onto recess 33 of rear exterior surface 39, seen in FIG. 1. While pressing and holding trigger 70, the user exerts force to overcome the force of firing pin spring 62, then turns key 50, seen in FIG. 1, thereby rotating cylindrical spacer sleeve assembly 30 to the locked mode position wherefore firing pin guide 64 and firing pin leg 64' rests upon front edge 34, thereby preventing the movement of pistol's firing pin assembly 60 when activated by trigger mechanism 70.

As best seen in FIG. 4, pistol P is in the firing mode. Firing pin guide 64 and firing pin leg 64' slidably travel along cut-outs 36 and 36' respectively and approach rear edges 38 and 38' respectively, shown in FIG. 1, when pistol P is cocked, thereby allowing the movement of the pistol's firing pin assembly 60 when activated by trigger mechanism 70. Pistol P may be of any variety of semi-automatic pistols that have an enclosed striker assembly. Such a pistol may be a "SMITH AND WESSON" without limitation to this specific brand.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A locking mechanism having an enclosed striker assembly, comprising:

A) a firing pin assembly having a shaft with first and second ends, said first end having a leg extending radially outwardly a first predetermined distance and a guide extending radially a second predetermined distance, said second end including a firing pin, said firing pin assembly further includes a stopper surface on said shaft at a third predetermined distance from said second end and a spring member receiving said shaft therethrough, and said spring member includes third and fourth ends, said third end coacts against said stopper surface and said fourth end includes a first spacer sleeve assembly rigidly mounted thereon that in turn coacts with said guide and leg, keeping said spring member biased against said stopper surface and said first spacer sleeve;

B) a second spacer sleeve assembly having fifth and sixth ends and longitudinal cutouts extending from said fifth end towards said sixth end a fourth predetermined distance without reaching said sixth end, said fifth end having cooperative dimensions to coact with said first spacer sleeve and selectively causing said spring member to compress, and said sixth end including a protrusion with a unique shape axially mounted thereon;

C) a keyed plate assembly having inner and outer walls and a central through opening, said inner wall including at least two cutouts with mating cooperative characteristics to receive said protrusion in at least two angular positions of said second spacer sleeve assembly; and D) means for rotating said second spacer sleeve assembly through said through opening so that said guide and leg are selectively brought in alignment with said fifth end thereby restricting the travel of said shaft and in alignment with said cut-outs having unobstructed travel that permits the operation of a pistol.

2. The locking mechanism having an enclosed striker assembly set forth in claim 1, wherein said rotating means includes a key, insertable through said central through opening of said key plate assembly to said protrusion so that a user exerting an inwardly and rotational force to overcome the force of said firing pin spring, and rotating said second spacer sleeve assembly selectively from a locked mode position to an unlocked mode position and vice-a-versa while a trigger of said pistol is pulled and held.

3. The locking mechanism having an enclosed striker assembly set forth in claim 2, wherein said means for rotating includes preventing the movement of said pistol's firing pin assembly when activated by said trigger.

4. The locking mechanism having an enclosed striker assembly set forth in claim 3, wherein said keyed plate assembly has at least one notch extending from said central through opening to view said protrusion to determine if said pistol is in a fire or locked mode.

5. The locking mechanism having an enclosed striker assembly set forth in claim 4, wherein said firing pin assembly has spring retaining cups between said spring member and said stopper surface.

* * * * *